US006749015B2

(12) United States Patent
Moreau

(10) Patent No.: US 6,749,015 B2
(45) Date of Patent: Jun. 15, 2004

(54) MULTICHANNEL TUBE HEAT EXCHANGER, IN PARTICULAR FOR MOTOR VEHICLE

(75) Inventor: Sylvain Moreau, Spay (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/914,465

(22) PCT Filed: Dec. 21, 2000

(86) PCT No.: PCT/FR00/03629

§ 371 (c)(1),
(2), (4) Date: Aug. 29, 2001

(87) PCT Pub. No.: WO01/50080

PCT Pub. Date: Jul. 12, 2001

(65) Prior Publication Data

US 2002/0134538 A1 Sep. 26, 2002

(30) Foreign Application Priority Data

Dec. 29, 1999 (FR) ..... 99 16666

(51) Int. Cl.[7] ..... F28F 9/02

(52) U.S. Cl. ..... 165/174; 165/175; 165/176; 165/177

(58) Field of Search ..... 165/173, 174, 165/176, 177, 175

(56) References Cited

U.S. PATENT DOCUMENTS

| | | | | | |
|---|---|---|---|---|---|
| 5,172,761 | A | * | 12/1992 | Lyon | 165/173 |
| 5,295,532 | A | * | 3/1994 | Hughes | 165/76 |
| 5,327,959 | A | * | 7/1994 | Saperstein et al. | 165/173 |
| 5,605,191 | A | * | 2/1997 | Eto et al. | 165/153 |
| 5,762,133 | A | * | 6/1998 | Dion | 165/173 |
| 5,894,886 | A | * | 4/1999 | Chiba et al. | 165/173 |
| 6,272,881 | B1 | * | 8/2001 | Kuroyanagi et al. | 165/153 |
| 6,302,196 | B1 | * | 10/2001 | Haussmann | 165/153 |
| 6,315,037 | B1 | * | 11/2001 | Haussmann | 165/153 |

* cited by examiner

*Primary Examiner*—Allen Flanigan
(74) *Attorney, Agent, or Firm*—Liniak, Berenato & White

(57) ABSTRACT

A heat exchanger including an array of tubes (10) mounted between two fluid boxes (28, 46) via respective manifolds (16) and designed to have a fluid run through. The tubes (10) include at least two channels separated by at least one longitudinal partition (78) and are arranged in a single row, parallel to the two large surfaces of the exchanger, such that the fluid circulation occurs in at least two layers parallel to the large surfaces of the exchanger and each formed by part of the tube channels. At least one of the fluid boxes (28, 46) includes an internal longitudinal partition (48, 68) dividing the fluid box into at least two longitudinal sections communicating with the two layers respectively. The invention is in particular applicable to air conditioning evaporators.

13 Claims, 3 Drawing Sheets

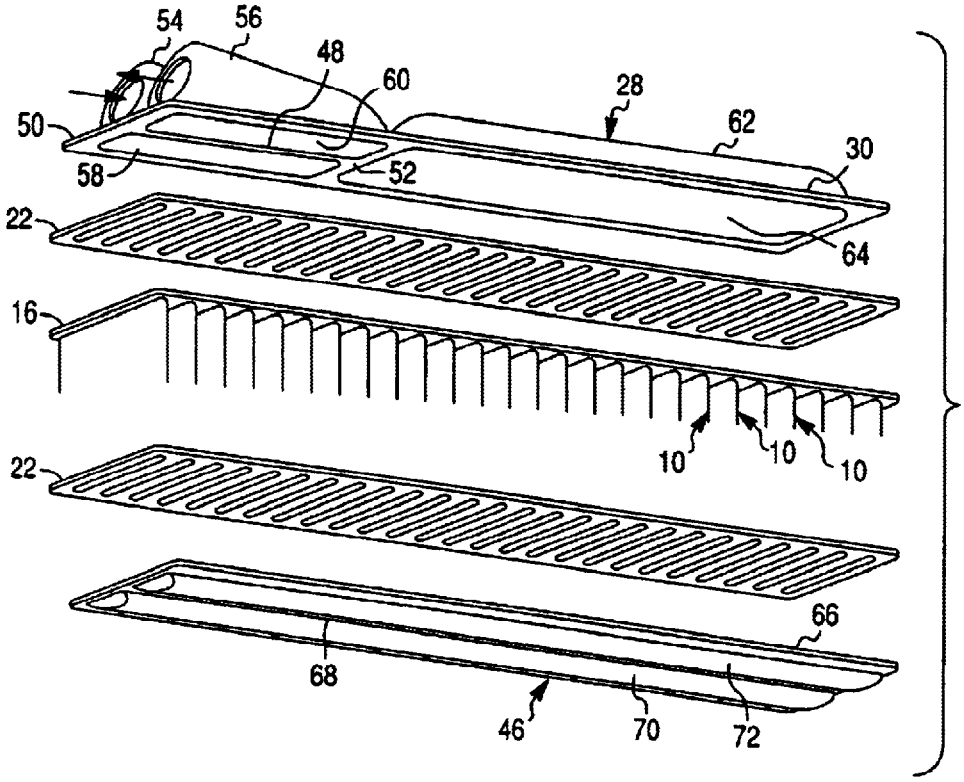
Fig. 4
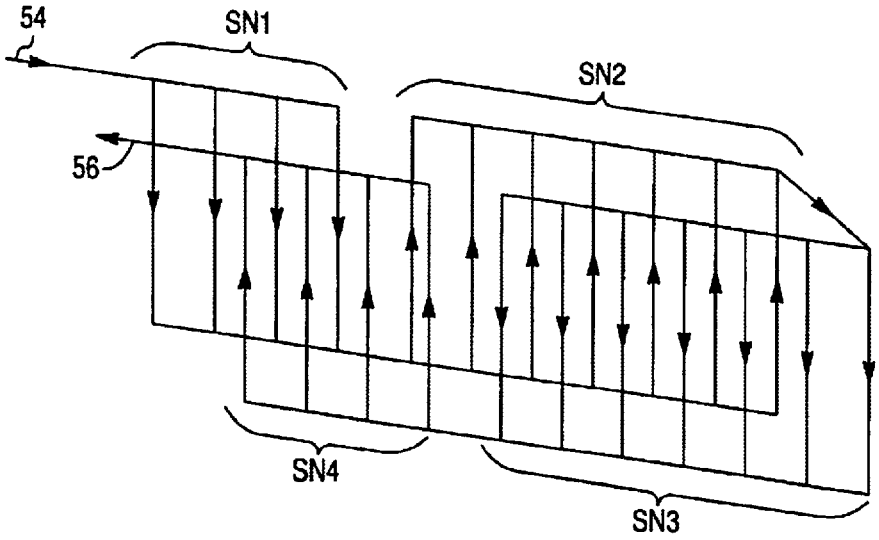
Fig. 5
Fig. 6
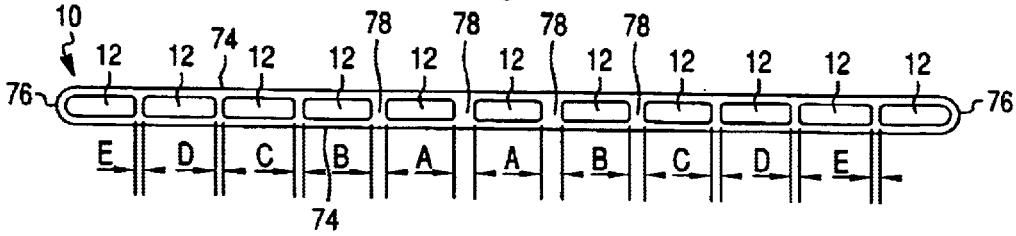

Fig. 7
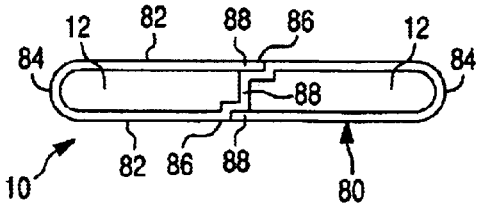
Fig. 8
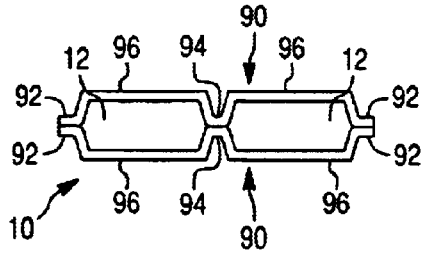
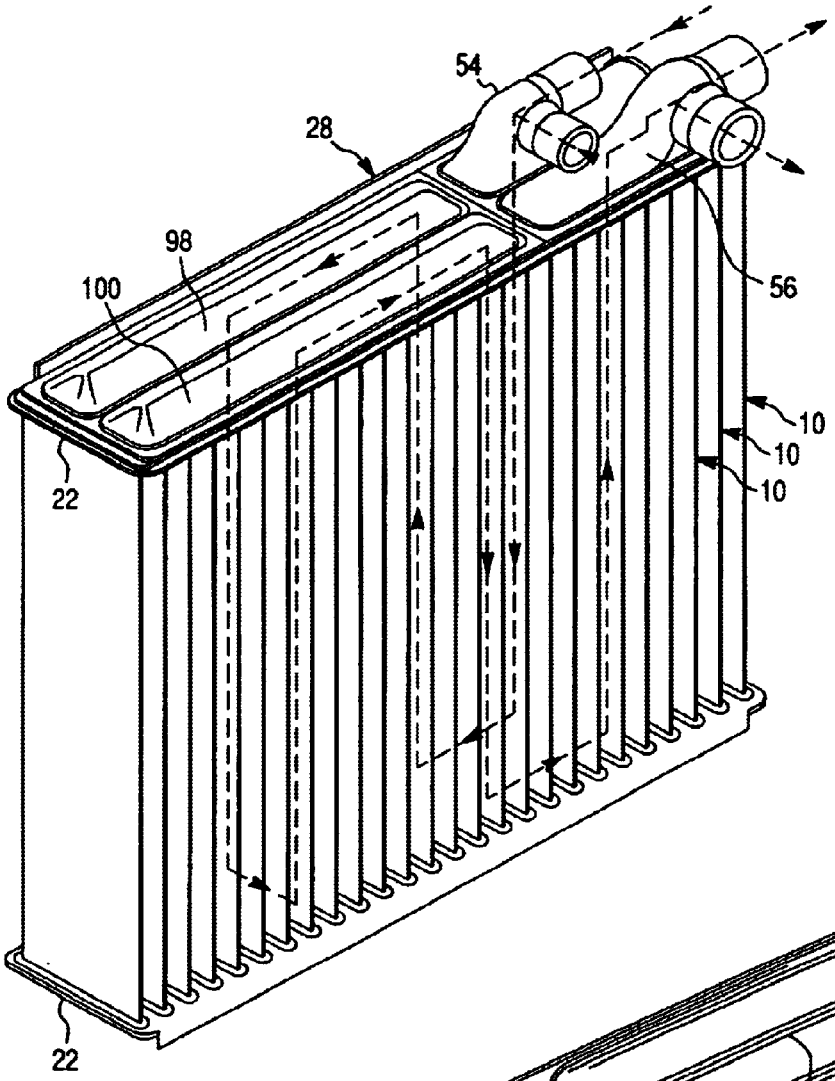
Fig. 9
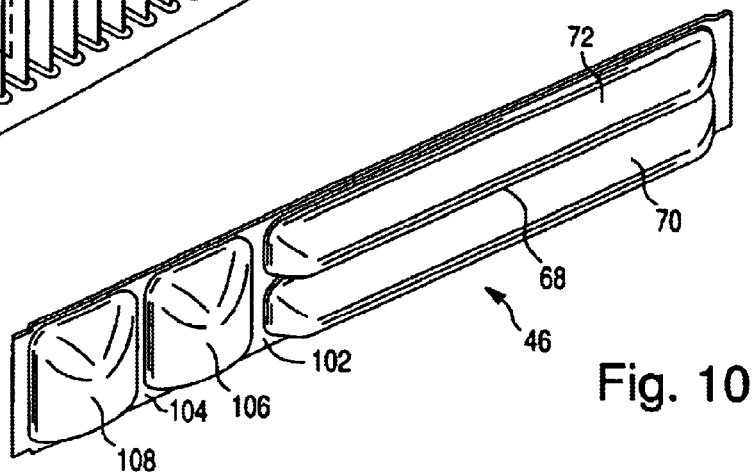
Fig. 10

MULTICHANNEL TUBE HEAT EXCHANGER, IN PARTICULAR FOR MOTOR VEHICLE

The invention relates to heat exchangers, for motor vehicles in particular.

It relates more particularly to a heat exchanger suitable for constituting either a radiator for cooling the engine, or a radiator for heating the passenger compartment, or even an evaporator or a condenser of an air-conditioning circuit.

A heat exchanger of this type generally comprises a bank of tubes mounted between two fluid chambers by way of respective manifolds, and is suitable for being traversed by a fluid. In the case of a radiator for cooling the engine or of a radiator for heating the passenger compartment, this fluid is the liquid serving for the cooling of the engine. In the case of an evaporator or of an air-conditioning condenser, this fluid is a refrigerant fluid.

The fluid is generally distributed among the tubes of the bank by successive passes in different groups of tubes and in given respective directions of circulation.

The bank usually comprises either flat tubes combined with spacers of corrugated shape, or tubes with a circular or oval cross-section passing through a series of fins. In this case, the change of pass is obtained by virtue of transverse and longitudinal partitions situated within the fluid chambers which are provided at the two ends of the bank of tubes.

These partitions are either affixed and brazed between the fluid chamber and the corresponding manifold, or obtained by stamping of the fluid chamber so as to define compartments which communicate respectively with groups of tubes of the bank.

In this known technique, the manifold includes apertures, also called slots, equipped with rising collars into which the extremities of the tubes are inserted and brazed.

This results in the necessity for the longitudinal partitions of the fluid chambers to be notched in order to fit perfectly with the shapes of the manifold.

Hence, in the prior art, the problem is always posed of obtaining perfect leaktightness between the manifold, the longitudinal partition of the fluid chamber and the tubes.

The object of the invention is especially to surmount the abovementioned drawbacks.

To that end the invention proposes a heat exchanger of the type defined in the introduction, in which the tubes each include several channels separated by at least one longitudinal partition and are arranged along a single row, parallel to two large faces of the exchanger. In this heat exchanger, the circulation of the fluid takes place in at least two layers parallel to the large faces of the exchanger and each formed by some of the channels of the tubes, and at least one of the fluid chambers comprises an internal longitudinal partition suitable for dividing the fluid chamber into at least two longitudinal compartments communicating respectively with the two layers.

Thus the heat exchanger of the invention comprises tubes each having several channels, the respective channels of each tube being divided in each case into at least two groups corresponding to circulation layers.

In the particular case of an exchanger with two circulation layers, each situated close to one of the large faces of the heat exchanger, each tube is divided into two groups, a first group which corresponds to a first layer and a second group which corresponds to a second layer.

These two layers thus communicate respectively with the two longitudinal compartments defined in at least one of the two fluid chambers.

A tube according to the invention includes at least two channels which then correspond respectively with the two abovementioned longitudinal compartments. In the case in which each tube includes more than two channels, the numbers of channels in the first group and in the second group may be equal or different.

According to another characteristic of the invention, at least one of the fluid chambers comprises at least one transverse partition suitable for dividing the fluid chamber into at least two transverse compartments at least one of which establishes a communication between two layers.

According to yet another characteristic of the invention, each layer is divided into at least two sub-layers linked in series and in which the circulation of the fluid takes place in counter-current mode from one sub-layer to the next one.

Hence, in a typical embodiment, the heat exchanger comprises two layers, each divided into two sub-layers, which makes it possible to define a circulation with four passes: two successive passes in the two sub-layers of a first layer, and then two successive passes in the two sub-layers of a second layer.

In one preferred embodiment of the invention, each manifold includes apertures, also called slots, surrounded by collars for the insertion of the extremities of the tubes of the bank, and provision is made for each manifold to be equipped with a flat surface for brazing of a fluid chamber.

This characteristic is particularly advantageous since it makes it possible to oppose a perfectly flat surface in order to position the longitudinal partition and/or the transverse partition of the fluid chamber.

To that end, provision is made for each fluid chamber to comprise a flat contour and at least one co-planar partition (longitudinal partition and/or transverse partition) suitable for being brazed against the surface of the manifold.

It can be envisaged producing the flat surface in a single piece with the manifold.

However, in one preferred embodiment of the invention, the flat surface of each manifold forms part of a manifold plate affixed by brazing onto the manifold and including apertures aligned with the apertures of the manifold.

This makes it possible to produce a flat, reference surface from a plate including apertures, advantageously obtained by punching.

The heat exchanger of the invention may comprise at least one lug originating from one edge of the manifold or from the manifold plate, or from the fluid chamber, the said lug being folded respectively onto one edge of the fluid chamber, or onto one edge of the manifold or of the manifold plate.

According to another characteristic of the invention, the extremity of at least one longitudinal partition of the tube is positioned substantially at the level of the flat surface of the manifold, in such a way that this longitudinal partition of the tube can be brazed onto an internal longitudinal partition of the fluid chamber.

The fluid chambers are advantageously each formed by stamping of a metal plate in order to define the flat contour and the co-planar partition.

Hence, when a fluid chamber is brazed against the corresponding flat surface, the contour of the fluid chamber and the partition or partitions thereof are brazed closely against the flat surface, which makes it possible to delimit compartments communicating with the tubes in an appropriate way for defining a circulation in several passes.

According to another advantageous characteristic of the invention, at least one of the fluid chambers comprises at least one inlet or outlet pipe for fluid.

The tubes of the heat exchanger of the invention are capable of numerous embodiment variants. Hence, provision may be made, for example, for each tube to be an extruded tube, or for each tube to be formed from sheet metal folded and closed by longitudinal brazed joints, or else for each tube to be formed from two stamped sheet metal plates which are brazed together so as to be leaktight.

According to yet another advantageous characteristic of the invention, the channels of the tubes are separated by partitions the respective thicknesses of which decrease from a central region of the tube towards the periphery.

In one preferred application of the invention, the heat exchanger constitutes an evaporator for an air-conditioning apparatus.

In the description which follows, given solely by way of example, reference is made to the attached drawings, in which:

FIG. 4 is a partial view in exploded perspective of a heat exchanger according to the invention;

FIG. 5 is a diagram showing the circulation of the fluid in the heat exchanger of FIG. 4;

FIG. 6 is a view in transverse section of a tube according to the invention formed by extrusion;

FIG. 7 is a view in transverse section of a tube according to the invention formed from a sheet of metal;

FIG. 8 is a view in transverse section of a tube according to the invention formed from two sheets of metal;

FIG. 9 is a partial view in perspective of a heat exchanger according to another embodiment of the invention; and FIG. 10 is a view in perspective of one of the fluid chambers of the heat exchanger of FIG. 9.

Figure 1:
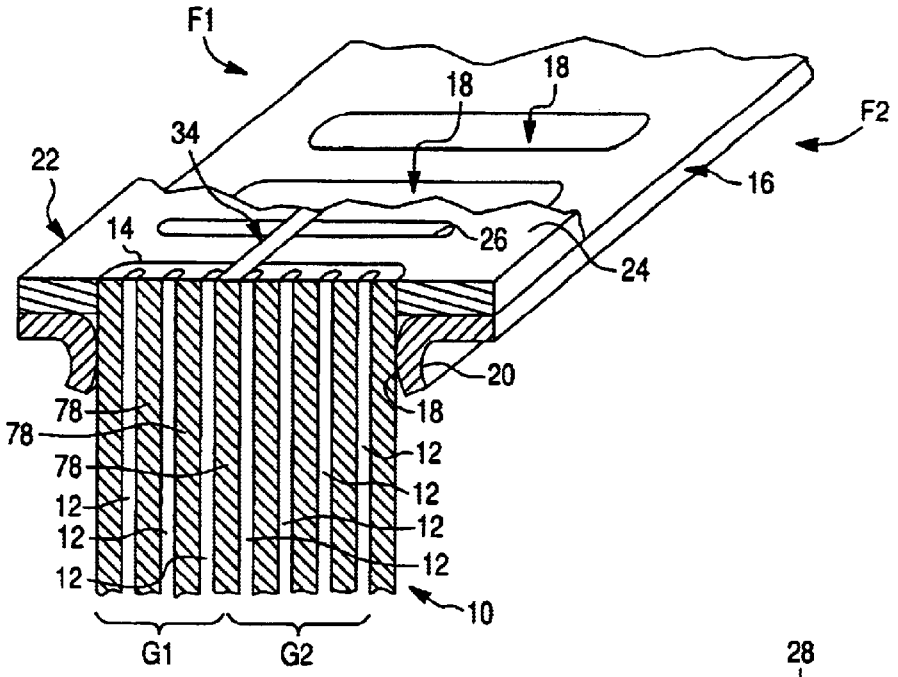
FIG. 1 is a partial view in perspective and in section of a part of a heat exchanger according to the invention, the view revealing the manifold, the manifold plate and one of the tubes of the bank.

Referring first of all to FIG. 1, a part of a heat exchanger is shown, comprising a bank having a multiplicity of tubes 10, only one of which is represented in FIG. 1. These are flat tubes, arranged into a single row, and produced by extrusion of a metallic material, preferably based on aluminum. These tubes include a plurality of parallel internal channels 12 which are seven in number, in the example, and are separated by longitudinal partitions 78. The row of tubes is parallel to two opposite large faces F1 and F2 of the heat exchanger.

The tubes 10 are mutually spaced so as to delimit a gap, between two adjacent tubes, which can be free or occupied by a corrugated spacer (not represented) forming a heat-exchange surface.

The tubes 10 have respective extremities 14 held in a manifold 16 consisting of a stamped metal plate of generally rectangular shape having two longitudinal sides corresponding respectively to the large faces F1 and F2 of the heat exchanger. The extremity 14 of each tube 10 defines a flat face which extends perpendicularly to the longitudinal direction of the tube and which also constitutes the extremity of each longitudinal partition 78.

The manifold 16 includes a plurality of apertures 18, also called slots, having an internal cross-section matching the external cross-section of a tube. Each of the apertures 18 is bordered by a collar 20 so that the apertures 18 can respectively hold the extremities 14 of the tubes 10 of the bank. The extremities 14 of the tubes are intended to be brazed with the respective collars 20 so as to provide a leaktight bond.

The manifold 16 holds a manifold plate 22 of rectangular shape advantageously produced from an aluminum-based material. This manifold plate 22 is intended to be brazed onto the manifold 16 and to provide a flat surface 24, forming a reference surface, and it includes a multiplicity of apertures 26, also called slots, arranged facing the respective apertures 18 of the manifold 16.

These apertures 26 have a shape matched to that of the extremities 14 of the tubes so that the latter are engaged, at least partly, into the apertures 26, without, however, protruding from the plane defined by the flat surface 24. In fact, the extremity 14 of each tube is positioned in such a way as to lie substantially at the level of the flat surface 24.

Figure 2:
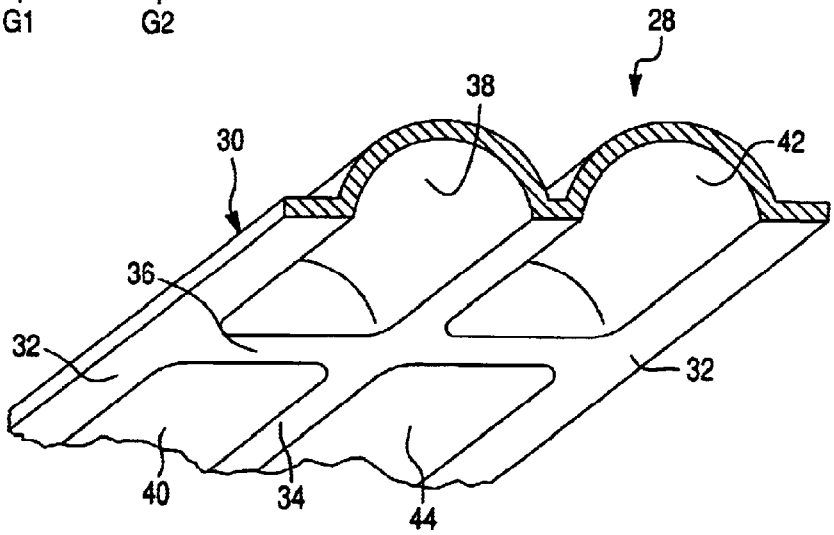
FIG. 2 is a partial view in perspective of a fluid chamber suitable for being brazed onto the manifold plate of the heat exchanger of FIG. 1.

The flat surface 24 is intended to hold a fluid chamber 28, as represented in FIG. 2, which is produced by stamping from a piece of sheet metal, advantageously based on aluminum.

The fluid chamber 28 of FIG. 2 comprises a peripheral contour 30 of generally rectangular shape which is flat and able to come to bear against the contour of the flat surface 24. To that end, the contour possesses a generally rectangular shape matched to the rectangular shape of the flat surface 24. In the example represented in FIG. 2, this contour especially comprises two longitudinal edges 32.

Furthermore, the fluid chamber 28 comprises a longitudinal partition 34 which extends parallel to the edges 32 and a transverse partition 36 which extends perpendicularly to the partition 34 and to the edges 32. The contour 30, as well as the partitions 34 and 36, are co-planar.

The fluid chamber 28 is stamped so as to delimit compartments between the flat contour 30 and the partitions 34 and 36. Four compartments are found here: two compartments 38 and 40 close to one of the edges 32 and two other compartments 42 and 44 close to the other edge 32.

It will be understood that when the fluid chamber 28 is placed and brazed against the flat surface 24, the longitudinal partition 34 comes to be placed in the position designated by the same reference in FIG. 1 and that the transverse partition 36 comes to be placed between two apertures 26 of the manifold plate 22.

Figure 3:
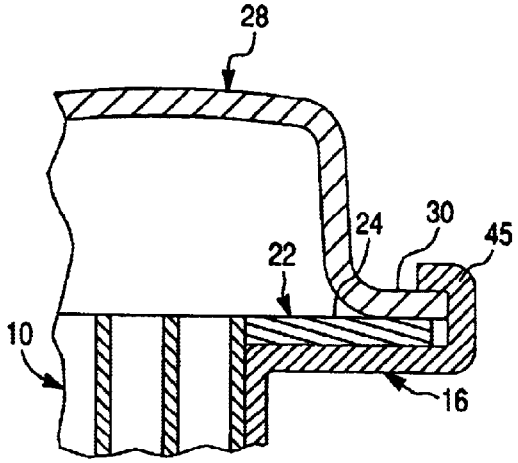
FIG. 3 is a partial view in section of a fluid chamber brazed onto a manifold plate of a heat exchanger according to the invention.

FIG. 3 shows the contour 30 of the fluid chamber 28 applied against the contour of the bearing surface 24 formed by the manifold plate 22, the latter being brazed onto the manifold 16. In the example represented, at least one lug 45 is provided originating from an edge of the manifold 16 and folded over an edge of the fluid chamber 28 so as to provide temporary retention of the assembly with a view to the brazing.

In a variant, the lug 45 could originate from one edge of the manifold plate 22 or of the fluid chamber 28 and be folded over respectively onto one edge of the manifold 16 or of the manifold plate 22.

In the example, the longitudinal partition 34 of the fluid chamber (FIG. 1) comes to be placed, for each tube, against the extremity of a longitudinal partition 78 of the tube. This makes it possible subsequently to braze the partition 34 of the fluid chamber against a partition 78 of each tube and, thus, to separate each tube into two groups: a first group G1, here formed from three channels, and a second group G2, here formed from four channels.

This makes it possible to define, in the heat exchanger, different circulation passes distributed into two layers, namely a first layer formed by the group G1 of the channels and a second layer formed by the group G2 of the channels.

The invention will now be explained in more detail by reference to FIG. 4 which describes an example of a heat exchanger produced as defined above.

It is seen in FIG. 4 that the heat exchanger comprises a bank formed from a plurality of tubes 10 as defined above, these tubes 10 being held, at their upper extremity, in a manifold 16 onto which is brazed a manifold plate 22, as defined above.

At their lower extremity, the tubes 10 are held in a similar manifold (not represented) onto which another, identical, manifold plate 22 is brazed.

These two manifold plates 22, arranged respectively at the upper and lower part, serve as reference plates for holding a first fluid chamber 28 (at the upper part) and a second fluid chamber 46 (at the lower part).

The fluid chamber 28 is produced in accordance with the teachings of FIG. 2. In this example, this fluid chamber comprises a flat contour 30 of generally rectangular shape, a longitudinal partition 48 which extends only along a part of the length and which links a transverse edge 50 of the contour to a transverse partition 52. The contour 30 and the partitions 48 and 52 are coplanar.

The fluid chamber 28 is produced by stamping so as furthermore to define an inlet pipe 54 and an outlet pipe 56 which communicate respectively with two compartments 58 and 60, which are separated by the longitudinal partition 48. Moreover, the fluid chamber 28 forms a dome-shaped part 62 delimiting a single compartment 64.

The fluid chamber 46 includes a flat contour 66 of generally rectangular shape and a longitudinal partition 68 which extends over the entire length and which is coplanar with the contour 66. The fluid chamber 46 comprises two longitudinal bulges 70 and 72 defining two corresponding elongate compartments which communicate with the bank.

Thus a heat exchanger is defined comprising a plurality of tubes 10, spacers if appropriate (not represented), two manifolds 16 (only one of which is represented), two manifold plates 22, as well as a fluid chamber 28 at the upper part and a fluid chamber 46 at the lower part.

The partition 68 of the fluid chamber 46 is intended to divide each tube in such a way that the compartment 70 communicates with the channels of the group G1 and the compartment 72 with the channels of the group G2.

The circulation of the fluid in the heat exchanger takes place in several passes as shown in FIG. 5. The fluid penetrates into the compartment 58 through the inlet pipe 54 and flows in a first sub-layer SN1 formed by the channels of the group G1 belonging to some of the tubes so as to reach the compartment 70 via a vertical flow from top to bottom.

Next the fluid flows from bottom to top from the same compartment 70 so as to reach the compartment 64, the flow taking place in a second sub-layer SN2. In this second sub-layer, the fluid flows in the group G1 of the channels of the other tubes of the bank.

Then the fluid reaches the compartment 72 via a vertical flow from top to bottom in a third sub-layer SN3, the flow taking place in the channels of the group G2 of some of the tubes.

Finally, the fluid reaches the compartment 60 via a vertical flow from bottom to top in a third sub-layer SN4, this flow of the fluid taking place in the group G2 of the channels of the other tubes. The fluid leaves the heat exchanger through the outlet pipe 56.

Hence the circulation of the fluid takes place in four passes and in alternate directions. The first two passes correspond respectively to the sub-layers SN1 and SN2. These two sub-layers belong to the same layer which extends in proximity to the large face F1 of the heat exchanger. The circulation then takes place in two other passes which correspond to the sub-layers SN3 and SN4. These two sub-layers form part of a second layer which is connected in series with the first layer and which extends parallel to the large face F2 of the heat exchanger. It will be understood that the first layer is formed by the groups G1 of the channels (here three in number) and the second layer by the group G2 of the channels (here four in number).

Referring now to FIG. 6, an extruded tube 10 according to the invention is shown, which comprises a multiplicity of channels 12, eleven in number in this example.

These channels each have a cross-section of substantially rectangular shape. The tube comprises two flat faces 74 connected by two semi-circular faces 76. The tubes are separated by partitions 78 which have variable thicknesses. The two partitions 78 situated in the central region have a thickness A and they are each followed by partitions having respective thicknesses B, C, D and E such that A>B>C>D>E. The thicknesses of the partitions thus decrease from the central region to the periphery.

In the embodiment of FIG. 7, the tube 10 is formed from a piece of sheet metal 80 folded in such a way as to include two opposite flat faces 82 joined by two end faces 84 of semi-circular profile. The sheet metal 80 includes two longitudinal edges 86 assembled respectively against an intermediate part 88 of the sheet metal of stepped structure forming a separation partition. The two edges 86 are assembled by longitudinal brazed joints 88 in such a way as to close the tube and to delimit two channels 12.

In the embodiment of FIG. 8, the tube 10 is formed from two stamped sheet-metal plates 90 which are brazed together so as to be leaktight. These two plates 90 have symmetrical profiles and each comprise two longitudinal end edges 92 and a central longitudinal edge 94, which are parallel to each other, which separate two bulges 96. The plates 90 are brazed together so as to be leaktight by their respective edges in such a way as to define two channels 12.

The heat exchanger of FIG. 9 is related to that of FIG. 4 but differs, however, by the structure of the fluid chamber 28 at the upper part and by the structure of the fluid chamber 46 at the lower part (FIG. 10).

The fluid chamber 28, as in the case of FIG. 4, comprises an inlet pipe 54 and an outlet pipe 56 which communicate respectively with two compartments 58 and 60 which are separated by a longitudinal partition 48. However, the partition 48 is continued beyond the transverse partition 52 in order to define two other compartments 98 and 100.

The fluid chamber 46 includes a longitudinal partition 68 which extends over a part of its length and which rejoins a transverse partition 102. Another transverse partition 104 is provided at a distance from the partition 102. It results therefrom that the fluid chamber 46 delimits two adjacent longitudinal compartments 70 and 72 on either side of the partition 68 and two transverse compartments 106 and 108 on either side of the partition 104.

The circulation of the fluid in the heat exchanger of FIGS. 9 and 10 takes place in six passes distributed into two layers. In the first layer, the fluid flows successively in the first group of channels by passing successively through the compartments 54, 70, 98 and 106, 98 and 108. Next, in the second layer, the fluid flows successively in the second group of channels by passing successively through the compartments 108 and 100, 106 and 100, 72 and 56.

The invention thus makes it possible to produce a heat exchanger obtained by brazing of metal pieces advantageously based on aluminum. The use of tubes with several channels makes it possible to define, in each tube, at least two groups of channels corresponding respectively to at least two circulation layers. Because each manifold offers a flat surface for affixing the manifold plate, that makes it possible to obtain perfect leaktightness between this flat surface and the fluid chamber and to define compartments for the circulation of the fluid in several passes.

In particular, the invention makes it possible to produce a heat exchanger with a circulation in two layers, which entails a better balancing in terms of temperature of the exchanger. This is most particularly beneficial in the case in which the heat exchanger is produced in the form of an evaporator.

In each layer, at least two passes, generally two, three or four passes, can be provided for.

In a general way, the invention makes it possible to simplify the method of assembling the heat exchanger while offering leaktightness.

Moreover, the heat exchanger thus produced possesses a reinforced resistance to bursting and makes it possible to reduce the pressure stresses on the fluid chambers and the manifolds, because each of the fluid chambers can have a lower height.

The invention finds a particular application in the field of heating and/or air-conditioning apparatus for motor vehicles.

What is claimed is:

1. A heat exchanger in the form of an evaporator comprising a bank of tubes (10) mounted between two fluid chamber covers (28, 46) by means of respective manifolds secure to the tubes (10) and suitable for being traversed by a fluid, wherein the tubes (10) each include at least two channels (12) separated by at least one longitudinal partition (68) and are arranged along a single row, parallel to two large faces (F1, F2) of the exchanger, wherein the circulation of the fluid takes place in at least two layers (SN1, SN2; SN3, SN4) parallel to the large faces of the exchanger and each formed by a part (G1; G2) of the channels (12) of the tubes, and wherein at least one of the fluid chamber covers (28, 46) comprises an internal longitudinal partition (48, 68) suitable for dividing a manifold chamber into at least two longitudinal compartments communicating respectively with the two layers, wherein said internal longitudinal partition is homogenously formed with said at least one of the fluid chamber covers, wherein each manifold (16) further comprises apertures (18) surrounded by collars (20) for the insertion of the extremities (14) of the tubes (10) of the bank, a manifold plate (22) is affixed by brazing to said manifold E—has been inserted and is equipped with a flat surface (22, 24) for brazing of at least one of said fluid chamber covers (28, 46) said manifold plate including apertures (26) aligned with the apertures (18) of the manifold.

2. The heat exchanger as claimed in claim 1, wherein at least one (28) of the fluid covers comprises at least one transverse partition (52) suitable for dividing the fluid chamber cover into at least two transverse compartments (58, 60; 64) at least one of which establishes a communication between two layers.

3. The heat exchanger as claimed in claim 1, wherein each layer is divided into at least two sub-layers (SN1, SN2, SN3, SN4) linked in series in which the circulation of the fluid takes place in counter-current mode from one sub-layer to the next one.

4. The heat exchanger as claimed in claim 1, wherein each fluid chamber cover (28, 46) comprises a flat contour (30, 66) and at least one co-planar partition (48, 52; 68) suitable for being brazed against the flat surface (24) of the manifold (16).

5. The heat exchanger as claimed in claim 1, which comprises at least one lug (45) originating from one edge of the manifold (16) or from the manifold plate (22), or from at least one of the fluid chamber covers (28; 46), the said lug being folded over respectively onto one edge of the fluid chamber cover (28; 46), or onto one edge of the manifold (16) or of the manifold plate (22).

6. The heat exchanger as claimed in claim 1, wherein the extremity (14) of at least one longitudinal partition (78) of the tube (10) is positioned substantially at the level of the flat surface (22, 24), in such a way that this longitudinal partition (78) of the tube can be brazed onto an internal longitudinal partition (48, 68) of the fluid chamber cover.

7. The heat exchanger as claimed in claim 4, wherein the fluid chamber covers (28, 46) are each formed by stamping of a metal plate in order to define the flat contour (30, 66) and the co-planar partition(s).

8. The heat exchanger as claimed in claim 6, wherein at least one of the fluid chamber covers (28, 46) comprises at least one inlet or outlet pipe (54, 56) for fluid.

9. The heat exchanger as claimed in claim 1, wherein each tube (10) is an extruded tube.

10. The heat exchanger as claimed in claim 1, wherein each tube (10) is formed from a piece of sheet metal (80) folded and closed by longitudinal brazed joints (88).

11. The heat exchanger as claimed in claim 1, wherein each tube (10) is formed from two stamped sheet metal plates (90) which are brazed together so as to be leaktight.

12. The heat exchanger as claimed in claim 1, wherein the channels (12) of the tubes (10) are separated by partitions (78) having respective thicknesses (A, B, C, D, E) which decrease from a central region of the tube towards the periphery.

13. The heat exchanger as claimed in claim 1, which is produced in the form of an evaporator for an air-conditioning apparatus.

* * * * *